US009580928B1

(12) United States Patent
Currid

(10) Patent No.: US 9,580,928 B1
(45) Date of Patent: Feb. 28, 2017

(54) ADAPTABLE TENT SYSTEM WITH INTERCONNECTING MEMBER

(71) Applicant: Tepui Outdoors, Inc., Soquel, CA (US)

(72) Inventor: Evan Michael Currid, Santa Cruz, CA (US)

(73) Assignee: Tepui Outdoors, Inc., Soquel, CA (US)

( * ) Notice: Subject to any disclaimer, the term of this patent is extended or adjusted under 35 U.S.C. 154(b) by 0 days.

(21) Appl. No.: 15/275,119

(22) Filed: Sep. 23, 2016

Related U.S. Application Data

(63) Continuation of application No. 15/254,983, filed on Sep. 1, 2016.

(60) Provisional application No. 62/213,600, filed on Sep. 2, 2015.

(51) Int. Cl.

| | |
|---|---|
| ***E04H 15/06*** | (2006.01) |
| ***E04H 15/56*** | (2006.01) |
| ***E04H 15/54*** | (2006.01) |
| ***E04H 15/64*** | (2006.01) |
| ***E04H 15/48*** | (2006.01) |

(52) U.S. Cl.
CPC ..... *E04H 15/06* (2013.01); *E04H 15/48* (2013.01); *E04H 15/54* (2013.01); *E04H 15/56* (2013.01); *E04H 15/64* (2013.01); *E04H 15/644* (2013.01)

(58) Field of Classification Search
CPC ..... E04H 15/06; E04H 15/644
USPC ..... 135/119, 88.13, 88.16; 296/160
See application file for complete search history.

(56) References Cited

U.S. PATENT DOCUMENTS 3,957,068 A * 5/1976 Cox ..... B60P 3/341 135/119
3,968,809 A * 7/1976 Beavers ..... E04H 15/06 135/120.3
4,058,133 A * 11/1977 Barr ..... B60P 3/38 135/132

(Continued)

OTHER PUBLICATIONS

AutoHome Columbus—The roof top car tent for any vehicle, download from http://www.autohomeus.com/roof-top-tents/columbus-tent/ on Apr. 11, 2016 (2 pages).

(Continued)

*Primary Examiner* — Noah Chandler Hawk
(74) *Attorney, Agent, or Firm* — Patent Law Works LLP

(57) ABSTRACT

An adaptable tent system is described. The adaptable tent system may include a base system having a rigid surface defining a perimeter edge and a canopy including a flexible membrane with a membrane edge and a canopy fastener, the canopy fastener extending along and fixably attached to the membrane edge, the canopy fastener adapted to mate with an interconnecting member fastener. The tent system may also include an interconnecting member including an interconnecting member body, an attachment member, and the interconnecting member fastener. The attachment member may be attached to the base member, so that the interconnecting member and base member are fixably attached together. The interconnecting member fastener may be configured to mate with any one of a plurality of different canopy fasteners so that when the canopy fastener and the interconnecting member fastener are mated, the interconnecting member and the canopy are connected.

7 Claims, 8 Drawing Sheets

(56) References Cited

U.S. PATENT DOCUMENTS

| | | | | | |
|---|---|---|---|---|---|
| 4,271,856 | A * | 6/1981 | Ferguson | B60P 3/38 | 135/132 |
| 5,190,066 | A * | 3/1993 | Joergensen | B60P 3/343 | 135/115 |
| 5,806,906 | A * | 9/1998 | Hammond | B60J 1/2011 | 296/165 |
| 6,035,875 | A * | 3/2000 | Chen | E04H 15/06 | 135/88.05 |
| 6,145,525 | A * | 11/2000 | Mooney | E04H 5/02 | 135/119 |
| 7,100,625 | B2 * | 9/2006 | Valles | E04H 15/08 | 135/119 |

OTHER PUBLICATIONS

Ebay Indigo Campers Roof Top Tent Review, download from https://outbackjoe.com/macho-divertissement/macho-articles/ebay-roof-top-tent-review/ on Apr. 11, 2016 (24 pages).

"Product Spotlight: The new ARB Simpson III Roof Top Tent," download from http://forum.ih8mud.com/threads/product-spot-light-the-new-arb-simpson-iii-roof-top-tent.306676/ on Apr. 11, 2016 (12 pages).

* cited by examiner

ADAPTABLE TENT SYSTEM WITH INTERCONNECTING MEMBER

CROSS-REFERENCE TO RELATED APPLICATIONS

This application is a continuation of U.S. application Ser. No. 15/254,983, entitled "Adaptable Tent System with Interconnecting Member," filed Sep. 1, 2016, which claims the benefit under 35 U.S.C. §119(e) of U.S. Provisional Application No. 62/213,600, entitled "Gimp with Zipper for interchanging a tent base platform with the tent canopy. The Gimp is constructed of the same or similar material to the tent and attached to the base. The Gimp has a zipper on the non-base side. The Gimp allows a person to remove the tent canopy from the tent base simply by unzipping along the perimeter. The Gimp can also be used for an annex attached underneath the vehicle tent's base for easy removal. The use of a gimp is in lieu of attaching the tent or annex to base," filed on Sep. 2, 2015, the entire contents of each of which are incorporated herein by reference.

BACKGROUND

The present disclosure relates to roof-top tents that are mountable on a vehicle.

Many outdoors enthusiasts enjoy camping, but setting up a tent can be time consuming and inconvenient, especially when there are no suitable places to put a tent. Additionally, it is frequently beneficial to be located off the ground to avoid disturbing or being disturbed by wildlife. One solution to such a problem is a roof-top tent that attaches to the top of a vehicle. Unfortunately, current roof-top tents also present various shortcomings. Existing roof-top tents may include a base that can be mounted to a vehicle and a fabric tent permanently affixed to the base. Such existing roof-top tents tend to be expensive, difficult to store, difficult to repair, and unable to adapt to various weather conditions or user needs, in part because they may be fixably attached to tent bases.

Accordingly, there is a need among such tents to provide a tent system which may be easily repaired, stored, replaced, or adapted to various weather conditions.

SUMMARY

According to one innovative aspect of the subject matter described in this disclosure, a tent system includes a base system, a first canopy, and first gimp. The base system may include a first base member, the first base member having a first rigid surface with a first perimeter edge, the first base member configured to mount to a vehicle, the first base member defining a first channel along at least a portion of the first perimeter edge, the first channel adapted to receive and retain a first attachment member. The first canopy may include a flexible membrane having a membrane edge and a first canopy zipper half, the first canopy zipper half extending along and fixably attached to the membrane edge, the first canopy zipper half having a first zipper tape and a first series of zipper teeth extending along and fixably attached to the first zipper tape, the first canopy zipper half adapted to mate with a first gimp zipper half. The first gimp may include a first gimp body, the first attachment member, and the first gimp zipper half, the first gimp body having a rectangular shape defining a first longitudinal edge and a second longitudinal edge, the first attachment member attached to the first gimp body along the first longitudinal edge, the first attachment member sized for insertion into the first channel defined by the first base member so that when the first attachment member is inserted into the first channel, the first gimp and the first base member are fixably attached together, the first gimp zipper half having a second zipper tape and a second series of zipper teeth extending along and fixably attached to the second zipper tape; the first gimp zipper half attached to the first gimp body along the second longitudinal edge, the first gimp zipper half configured to mate with a plurality of different canopy zipper halves so that when the first canopy zipper half and the first gimp zipper half are mated, the first gimp and the first canopy are connected.

These and other implementations may each optionally include one or more of the following features: that the first gimp zipper half and the first canopy zipper half form a quick release system, the quick release system allowing the first canopy to be quickly disconnected from the base system, the quick release system further allowing the first canopy to be quickly aligned and connected to the base system; that the first attachment member includes a bolt cord, the bolt cord including a cord longitudinally attached to the first gimp body along the first longitudinal edge, the bolt cord adapted for insertion into the first channel of the first base member; that the first canopy further includes a flap attached to the flexible membrane along the membrane edge, the flap adapted to overlap the first zipper half, the second zipper half, the first gimp body, and the first perimeter edge of the first base member when the first canopy is attached to the first base member via the first gimp, the flap providing weather protection for the first canopy zipper half, the first gimp zipper half, the first gimp body, and the first perimeter edge of the first base member; that the base system further comprises a second base member, the second base member having a hinge and a second rigid surface defining a second perimeter edge, the hinge pivotally attaching the first base member to the second base member, the second base member defining a second channel along the second perimeter edge, the second channel adapted to receive and retain a second attachment member, the second rigid surface positioned substantially planar with the first rigid surface when the first base member is mounted to the vehicle and the second base member is in an open position, the second base member adapted to fold into a parallel plane over the first base member when the tent system is in a closed position; a second gimp including a second gimp body, the second attachment member, and a second gimp zipper half, the second gimp body having a rectangular shape defining a third longitudinal edge and a fourth longitudinal edge, the second attachment member attached to the second gimp body along the third longitudinal edge, the second attachment member sized for insertion into the second channel defined by the second base member so that when the second attachment member is inserted into the second channel the second gimp and the second base member are fixably attached to each other, the second gimp zipper half having a third zipper tape and a third series of zipper teeth extending along and fixably attached to the third zipper tape; the second gimp zipper half attached to the second gimp body along the fourth longitudinal edge, the second gimp zipper half configured to mate with any one of a plurality of different canopy zipper halves so that when the first canopy zipper half and the second gimp zipper half are mated, the second gimp and the first canopy are connected; that the first gimp includes a second gimp zipper half attached to the first gimp body along the second longitudinal edge, the second gimp zipper half having a third zipper tape and a third series of zipper teeth extending along and fixably attached to the third zipper tape, the second gimp zipper half configured to mate with a plurality of different canopy zipper halves; and a second canopy, the second canopy including a second flexible membrane defining a second membrane edge and a second canopy zipper half, the second canopy zipper half extending along and fixably attached to the second membrane edge, the second canopy zipper half having a third zipper tape and a third series of zipper teeth extending along and fixably attached to the third zipper tape, the second canopy zipper half adapted to mate with a second gimp zipper half.

In general, another innovative aspect of the subject matter described in this disclosure may be embodied in methods that include operations for the use and manufacture of the system above.

It should be understood that the language used in the present disclosure has been principally selected for readability and instructional purposes, and not to limit the scope of the subject matter disclosed herein.

BRIEF DESCRIPTION OF THE DRAWINGS

The disclosure is illustrated by way of example, and not by way of limitation, in the figures of the accompanying drawings in which like reference numerals are used to refer to similar elements.

DETAILED DESCRIPTION

Figure 1:
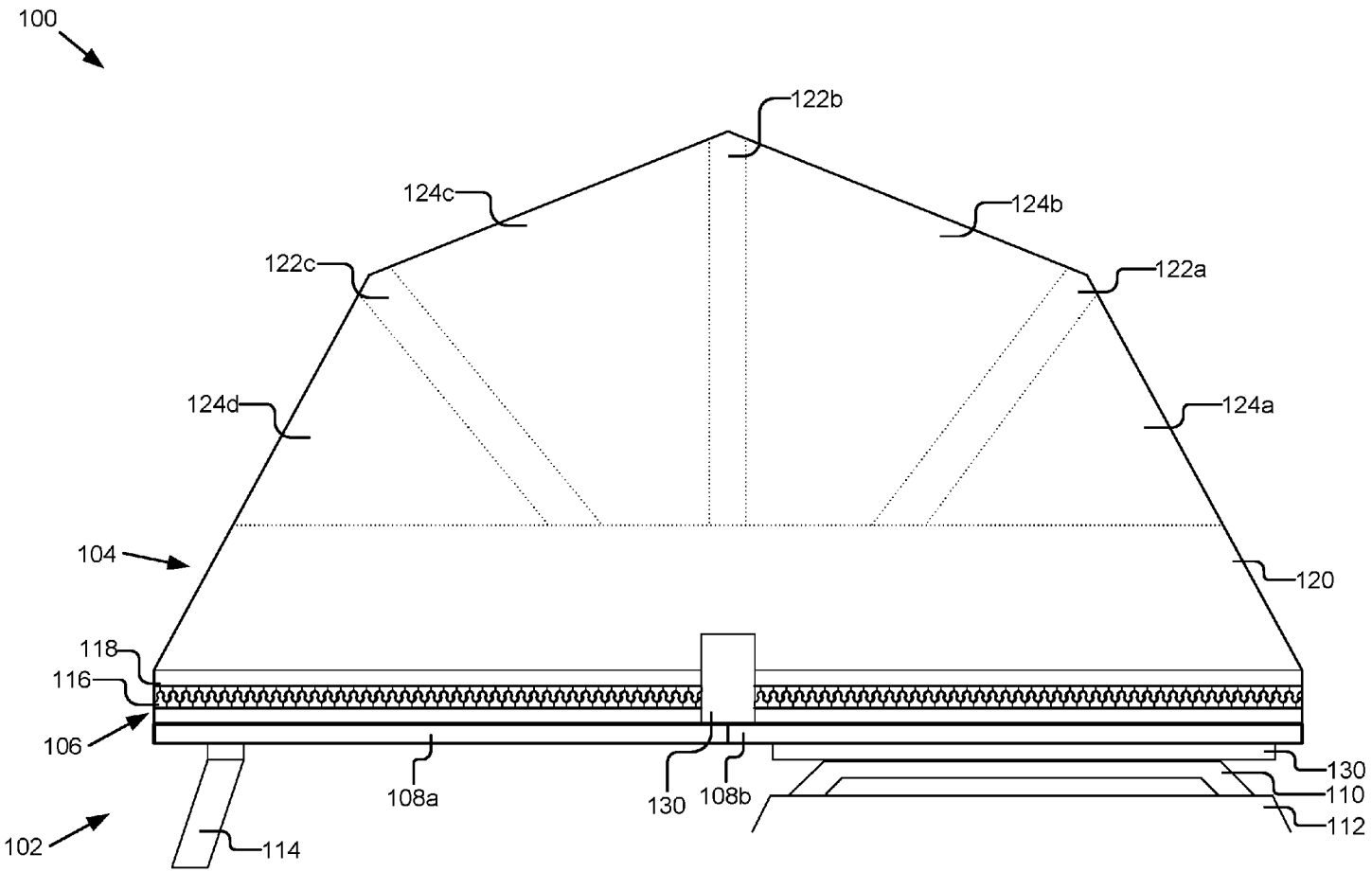
FIG. 1 is a side view of an example implementation of a tent system, according to the present disclosure, in an open position.

For the purposes of this disclosure, reference numbers may be used to refer to components found in any of the figures, regardless whether those reference numbers are shown in the figure being described. Further, where a reference number includes a letter referring to one of multiple similar components (e.g., component 000a, 000b, and 000n), the reference number may be used without the letter to refer to one or all of the similar components.

The present disclosure describes an innovative technology relating to an adaptable tent system 102 with interconnecting member 106 (hereinafter "tent system"). The tent system 102 solves many of the shortcomings of existing tents, especially roof-top tents, such as described in the background section of this disclosure. The tent system 102 may include a tent base system 202 (hereinafter "base system"), a tent canopy 104 (hereinafter "canopy"), and an interconnecting member 106. The interconnecting member 106 may have an interconnecting member fastener 116 for connecting the interconnecting member 106 to the canopy 104. The interconnecting member 106 may also have an attachment member 308 for connecting the interconnecting member 106 to the base system 202. For example, the interconnecting member 106 allows a base system 202 and canopy 104 to be easily separable so that the canopy 104 can be easily replaced, repaired, and/or stored. The interconnecting member 106, base system 202, and canopy 104 are described in further detail throughout this disclosure. In some implementations, due to the unique nature of the fasteners 116 and/or 118 (e.g., which may include a special zipper) multiple canopies 104 can be interchangeably mounted to the base system 202, or even simultaneously mounted to the base system 202, to provide adaptability to various weather conditions or user needs. Accordingly, users, warehouses, and stores may store fewer base systems 202 and more canopies 104 while still satisfying the diverse needs of users.

According to some implementations, the tent system 102 may include an interconnecting member 106 with an interconnecting member fastener 116 running along a first longitudinal side 412 of the interconnecting member 106. In some implementations, the body 306 of the interconnecting member 106 may be constructed of the same or similar material as the canopy 104 and may be attached to the base system 202, for example, using a bolt cord 404 running along a second longitudinal side 408 of the interconnecting member body 306. The interconnecting member 106 may allow quick release of the canopy 104 from the base system 202, for example, a user may remove the canopy 104 from the base system 202 simply by unzipping along the perimeter of the canopy 104. In some implementations, the interconnecting member 106 may also, or alternatively, be used to attach an annex tent 702 underneath the base system 202. In some implementations, the interconnecting member 106 may include a gimp 406 (e.g., a narrow trim or strip of fabric).

Figure 2A:
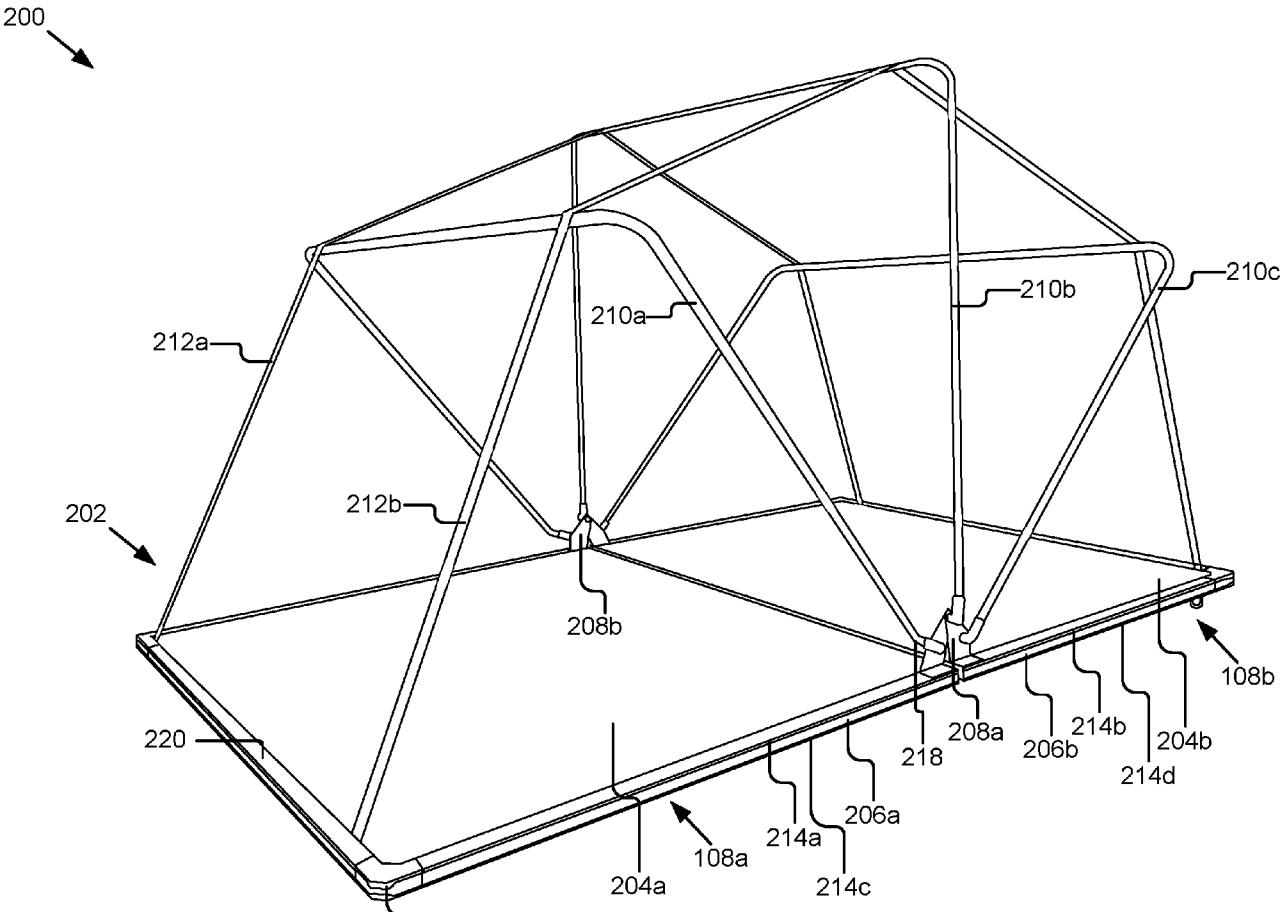
FIG. 2A is a perspective view of an example implementation of a base system, according to the present disclosure, in an open position.
Figure 2B:
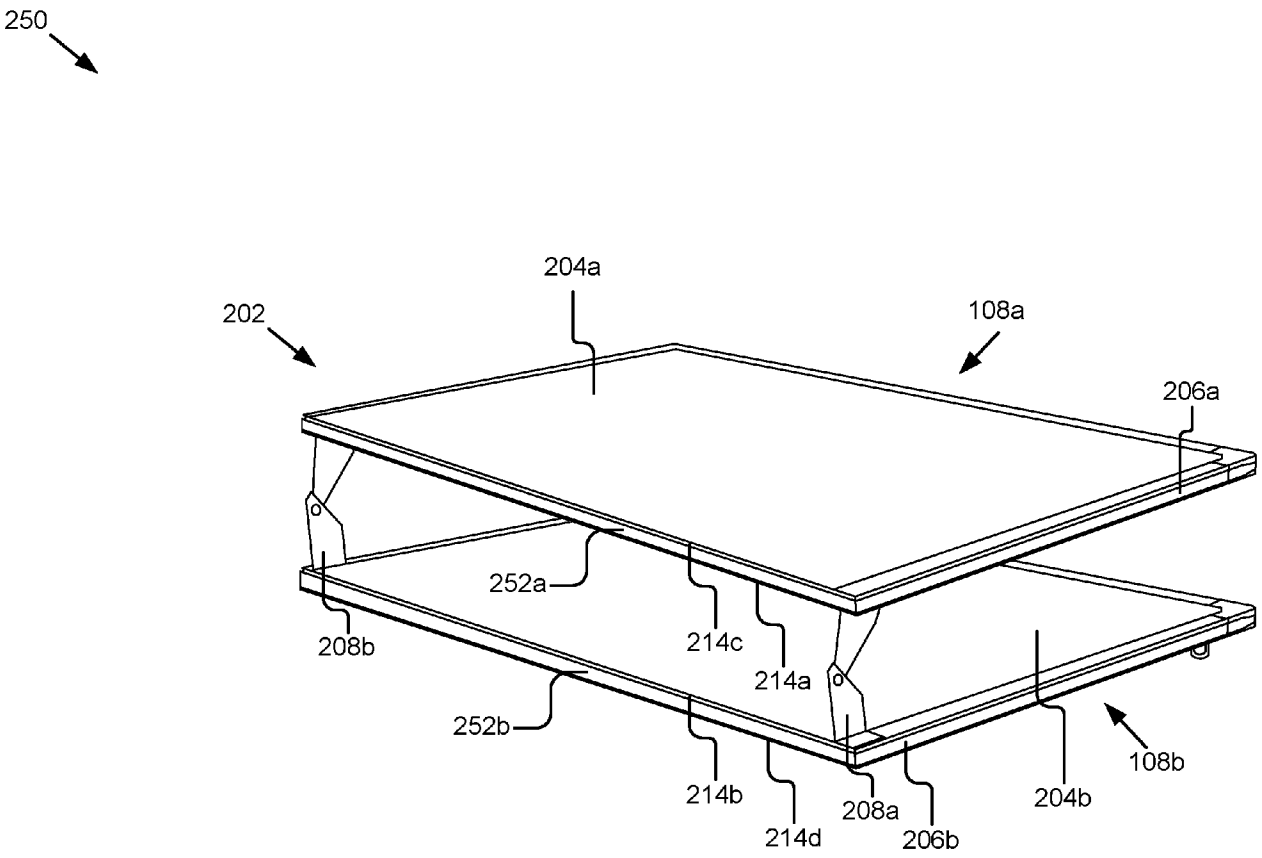
FIG. 2B is a perspective view of an example implementation of a base system, according to the present disclosure, in a closed position.

FIG. 1 is a side view 100 of an example implementation of a tent system 102 in an open position (e.g., an open position is shown in FIG. 2A and a closed position is shown in FIG. 2B). In some implementations, the tent system 102 may include a canopy 104, an interconnecting member 106, and one or more base members 108*a* and 108*b* (e.g., the base members 108*a* and 108*b* are components of a base system 202).

Each of the base members 108*a* and 108*b* may include a rigid surface defining a perimeter edge 206 and may be attachable to a roof rack 110 of a vehicle 112. Additionally, a base member 108 may include, or have attached thereto, a support 114 to support the base member 108. In some implementations, the base member 108 may include a channel along the perimeter edge 206 which is configured to receive and retain an attachment member 308 of the interconnecting member 106.

A base member 108 may include mounting hardware, such as transversely mounted rails 130 configured to rest perpendicularly across a standard vehicle roof rack 110 (although the rails 130 or other mounting hardware may have other configurations). In some implementations, the mounting hardware may include welds, bolts, or any other hardware, which may be used to securely attach the base member 108 to the vehicle 112. The base members 108 are described in further detail throughout this disclosure, especially in reference to FIGS. 2A and 2B.

The support 114 may include any mechanism configured to support the base member 108. For example, in some implementations, the support 114 may be a ladder attached to the bottom or side of the base member 108. The ladder may then be used both to support the base member 108 and to enable a user to climb into the tent system 102. The support 114 may be attached to the base member 108 using bolts, rivets, adhesive, or any other mounting mechanism. In some implementations, the support 114 may fold along the surface of the base member 108 for storage when not needed to support the base member 108. In some implementations, the support 114 may be slidably mounted to the base member 108, allowing the support 114 to be deployed under or adjacent to the base member 108 to provide vertical support, and then to slide or retract into a cavity formed in the base member 108 for storage.

The interconnecting member 106 may serve as an adapter between the base member 108 and the canopy 104 allowing the canopy 104 to be detachably securable to the base member 108. Thus, a single base member 108 may be used with a variety of canopies 104. In some implementations, the interconnecting member 106 may include an interconnecting member body 306, an attachment member 308 (the interconnecting member body 306 and attachment member 308 are described in further detail in reference to FIG. 3), and an interconnecting member fastener 116. The interconnecting member body 306 connects the attachment member 308 to the interconnecting member fastener 116, among other functionality, as described elsewhere herein. The attachment member 308 may fixably attach the interconnecting member 106 to the base member 108. The interconnecting member fastener 116 may detachably mate with a canopy fastener 116 of the canopy 104. The interconnecting member 106 is described in further detail throughout this disclosure, for example in reference to FIGS. 3-7. It should be noted that although the interconnecting member fastener 116 and canopy fastener 118 are shown including zippers, other implementations for fastening the canopy 104 to the interconnecting member 106 are possible and contemplated herein. The canopy fastener 118 is described in further detail elsewhere herein, for example, in reference to FIG. 3.

The canopy 104 covers at least a portion of the base member 108 to form the tent roof and/or sides. In some implementations, the canopy 104 includes a flexible membrane, which may include or define a membrane edge 132. The membrane edge 132 may include a canopy fastener 118 affixed thereto for connecting to the interconnecting member fastener 116. In some implementations, the canopy 104 may include a bottom pan membrane (not shown) with the membrane edge 132 being located along the intersection between the bottom pan membrane and the flexible membrane. In some implementations, the canopy 104 may include a slit flap 130, as described in reference to FIG. 6.

The flexible membrane may be constructed of any type of flexible material, such as fabric, canvas, mesh, vinyl, nylon, polyester, etc. In particular, one of the benefits of the adaptable tent system 102 described herein is the ability to use additional, fewer, or different materials to construct the flexible membrane than are used in existing tents. For example, the flexible membrane may be constructed entirely (or mostly) of mesh, because the tent system 102 described herein may allow an additional canopy 104 (e.g., constructed of water resistant canvass) to be connected to the base member 108, in addition to or in place of the first mesh canopy 104.

For example, the interconnecting member 106 enables a user to quickly and easily replace a mesh canopy 104 (e.g., for dry or summer use) with a water resistant canopy 104 (e.g., for rain). In some implementations, the interconnecting member 106 may enable a first canopy 104 (e.g., a water resistant canopy 104) to be attached to the base member 108 at the same time as a second canopy 104 (e.g., a mesh canopy 104). For example, the interconnecting member fastener 116 is configured to quickly and interchangeably align any canopy fastener 118 and affix the corresponding canopy(ies) 104 to the base member 108.

In some implementations, the canopy 104 may be shortened slightly over a tent canopy where no interconnecting member 106 is used, so that the combined size of the interconnecting member 106 and the canopy 104 corresponds to the size of the tent canopy where no interconnecting member 106 is used.

As shown in FIG. 1, the flexible membrane of the canopy 104 may be constructed of one or more component membranes. For example, in the illustrated implementation, the flexible membrane includes a solid membrane 120, reinforcing membranes 122*a*, 122*b*, and 122*c*, and one or more mesh membranes 124*a*, 124*b*, 124*c*, and 124*d*. For example, the mesh membrane 124 may be the top two thirds of the flexible membrane of the canopy 104 and the bottom one third of the flexible membrane may include the solid membrane 120.

The tent system 102 provides a means (e.g., via the interconnecting member 106) to replace or supplement a substantially mesh canopy 104 with a separate water-resistant canopy 104 (e.g., a canopy 104 that is solid and/or treated so that it is substantially impermeable to rain). In some instances, a second canopy 104 can be attached to the base system 202 in place of a first canopy 104. In some instances, a second canopy 104 can be attached to the base system 202 over the top of a first canopy 104 to provide weather protection for all or most of the first canopy 104. The interconnecting member 106 allows the second canopy 104 to be quickly and securely attached to the base system 202, thereby providing better weather protection than possible with existing tents. Because the second canopy 104 improves weather protection, the first canopy 104 can include a flexible membrane made completely or mostly from a breathable material, such as a mesh membrane 124.

In some implementations, the canopy 104 may include one or more reinforcing membranes 122*a*-122*c*, which may be constructed of heavier material (e.g., than the mesh membrane 124) and provide reinforcement to the canopy 104, especially where the flexible membrane overlaps tent poles 210. For example, because the canopy 104 illustrated in FIG. 1, is constructed largely of mesh material, the reinforcing membranes 122*a*-122*c* provide additional strength to the canopy 104 in areas of higher stress, such as, over the poles 210. The heavier material of the reinforcing membranes 122 may include fabric, canvas, vinyl, nylon, polyester, etc., as discussed elsewhere herein. The reinforcing membranes 122 may include strips of material that are sewn, welded, or otherwise attached to the mesh membranes 124, as shown in FIG. 1.

The vehicle 112 may include any vehicle capable of supporting the tent system 102, however, it should be understood that the tent system 102 may be used in other configurations. For example, although the tent system 102 is particularly beneficial for use when mounted to a vehicle 112, due to base member's 108 rigid surface, the tent system 102 may be placed on the ground, or mounted to any other object (e.g., a tree, ropes, a stand, etc.).

FIG. 2A is a perspective view 200 of an example implementation of a base system 202 in an open position. The base system 202 may include one or more base members 108*a* and 108*b*. As shown, the base system 202 may include one or more rigid surfaces 204*a* (e.g., of a first base member 108*a*) and 204*b* (e.g., of a second base member 108*b*), each rigid surface 204*a* and 204*b* defining a perimeter edge 206*a* and 206*b*, respectively. The rigid surfaces 204*a* and 204*b* may be pivotally attached together using one or more hinges 208*a* and 208*b*. Further, in some implementations, the base system 202 may include one or more poles 210*a*, 210*b*, and 210*c* connected to the hinges 208 or to one or both of the rigid surfaces 204*a* and 204*b*. The rigid surfaces 204, hinges 208, and poles 210 are each described in more detail below. Further, it should be noted that aspects of certain components may be described in reference to one component, but these aspects may be applicable to none, some, or all of the components. For example, features described in reference to base member 108*a* may be equally applicable to base member 108*b* and vice versa.

As illustrated in FIG. 2A, the second rigid surface 204*b* may be positioned on a substantially horizontal plane with the first rigid surface 204*a* when the tent system 102 is in an open position. Further, the second rigid surface 204*b* may be adapted to fold over the first rigid surface 204*a* when the tent system 102 is in a closed position, for example, as shown in FIG. 2B.

The rigid surfaces 204*a* and 204*b* may be solid or include some other construction, such as a flat top and an interior constructed using honeycombs, corrugations, foam, hat channels, I beams, or any other construction that allows the rigid surface to remain substantially rigid when supporting the weight of a user and/or gear inside the tent, especially when the tent system 102 is in an open position. A rigid surface 204 may be constructed of steel, aluminum, fiberglass, wood, carbon fiber, or one or more other materials that provide sufficient strength to support the weight of a user and/or gear.

Each rigid surface 204 may be a rectangular prism, although other implementations are possible. In some implementations, each rigid surface 204 may have one or more perimeter edges 206. For example, as shown, a first rigid surface 204*a* has a first perimeter edge 206*a* and a second rigid surface 204*b* has a second perimeter edge 206*b*. In some implementations, the rigid surface 204 has an attachment member receptacle 214 along the perimeter edge 206 (e.g., each perimeter edge 206*a* and 206*b* may define one or more channels 214*a*, 214*b*, 214*c*, and 214*d*). For example, an attachment member receptacle 214 may extend along three sides of the perimeter edge 206 of each rigid surface 204. In implementations where the base system 202 includes two rigid surfaces 204*a* and 204*b*, the attachment member receptacle 214 may extend around four sides of the perimeter edge of the base system 202 (e.g., six total sides of the perimeter edges 206*a* and 206*b* of the two rigid surfaces 204*a* and 204*b*). In another example, the attachment member receptacle 214 may extend along four sides of the perimeter edge 206 of a rigid surface 204 in implementations where the base system 202 includes a single rigid surface 204. It should be understood that other implementations are possible and contemplated herein, for example, a first rigid surface 204*a* may define an attachment member receptacle 214*a* along four sides of its perimeter edge 206*a*, while a second rigid surface 204*b* may define an attachment member receptacle 214*b* along only three sides of its perimeter edge 206*b*. The rigid surfaces 204*a* and 204*b* may also include second attachment member receptacles 214*c* and 214*d*, respectively. For example, as described in reference to FIG. 6, such a configuration of different sized interconnecting members 106 would allow features such as a cover to be attached when the tent system 102 is in a closed position.

Each attachment member receptacle 214 may be adapted to receive and retain an attachment member 308. For example, the attachment member receptacle 214 may be a channel formed within the perimeter edge 206 or formed within a component 220 attached to the perimeter edge 206. The channel may be shaped in such a way as to receive an attachment member 308, such as a bolt cord 404. In particular, the attachment member receptacle 214 may be configured so that an attachment member 308 may be attached thereto, but so that the attachment member 308 is not easily removed once inserted into the attachment member receptacle 214. For example, the attachment member 308 may be formed within or inserted into the attachment member receptacle 214 at the factory (e.g., using screws or specialized tools). The attachment member receptacle 214 may have an opening 216 through which the attachment member 308 can be inserted into the attachment member receptacle 214. Although an opening 216 is shown at the corner of the rigid surface 204 in the example of FIG. 2A, it should be understood that other implementations are possible. For example, the tent system 102 according to the techniques described herein may include an opening at a single corner of the rigid surface 204 or at the end of an attachment member receptacle 214.

Although some implementations of the tent system 102 enable a single attachment member receptacle 214*a* to be used, some implementations provide a second attachment member receptacle 214*c* to be included along a perimeter edge 206 of one or more of the rigid surfaces 204. In implementations where a second attachment member receptacle 214*c* is provided, the tent system 102 may provide for a second interconnecting member 106 to be connected to the same base member 108*a*. For example, in implementations where a second interconnecting member 106 is used in a second attachment member receptacle 214*c*, the second interconnecting member 106 may be slightly wider than a first interconnecting member 106 used in a first attachment member receptacle 214*c* (e.g., wider by the width of the thickness of the rigid surface 204*a*). For example, if the thickness of the rigid surface 204*a* is one inch, the distance between the first attachment member receptacle 214*a* and the second attachment member receptacle 214*c* is one inch, then the second interconnecting member 106 may be one inch wider than the first interconnecting member 106 so that canopies 104 of the same size can be attached to each of the first and the second interconnecting members 106. Similarly, a second canopy 104 (e.g., a fly or rain-resistant canopy 104) may be slightly longer than a first canopy 104 to accommodate for the additional thickness of the rigid surface 204.

As shown in the depicted implementation, the first attachment member receptacle 214*a* may be positioned along a top corner of the perimeter edge 206*a* and the second attachment member receptacle 214*c* may be positioned along a bottom corner of the perimeter edge 206*a*. In some implementations, the first attachment member receptacle 214*a* and the second attachment member receptacle 214*c* may both be positioned on the top of the rigid surface 204*a* along the perimeter edge 206*a*.

The hinge(s) 208 may include any type of hinge mechanism which allows the base system 202 to fold to a closed position (e.g., as in FIG. 2B), but remain substantially flat in an open position. Further the pivot point of the hinge 208 may be raised off the plane formed by the rigid surfaces 204, so that when the base system 202 is folded in a closed position, there is enough space between the rigid surfaces 204 to fit any poles 210 or other components (e.g., canopy (ies) 104, interconnecting member(s) 106, pads, etc.). Each side of the hinge 208 may be bolted to, welded to, integrally formed with, or otherwise attached to the rigid surfaces 204.

The poles 210 may be configured to form a frame that supports the canopy 104 when the canopy 104 is mounted to the base system 202. In some implementations, the poles 210 may be integrated with or attached to the canopy 104 and attachable to receptacles in one or more base members 108.

The poles 210 may be constructed of a rigid material, such as metal (e.g., aluminum, steel, etc.), plastic, carbon fiber, etc. The cross section of each pole 210 may be circular, flat, rectangular, or any other sufficiently strong shape. In some implementations, the poles 210 may have a three sided rectangular shape with rounded corners, as shown in FIG. 2A. In some implementations, the poles 210 may have other shapes, such as half circles, octagons, straight poles, etc., without departing from the scope of this disclosure.

In some implementations, the poles 210 may be connected to the base system 202. For example, as shown, the poles 210 may be connected to the hinges 208. In some instances, the poles 210 may be connected to the hinge 208 to fold substantially flat when the base system 202 is in a closed position. For example, one or more of the poles 210 may include a bend 218 that is configured to allow the poles 210 to lay substantially flat when the base system 202 is in a closed position. In some implementations, the poles 210 may all be attached to and pivot about an axis of a hinge 208*a* and/or 208*b*, such that the poles 210 fold to a thickness no greater than that of the poles 210 themselves.

In some implementations, the poles 210 may be connected using one or more straps 212*a* and 212*b*. The straps 212 may be cables or strips of material constructed of fabric, metal, rope, or other flexible material. The straps 212 may be connected to the poles 210, wrapped around the poles 210, or not connected to the poles, for example. The straps 212 may further connect the poles 210 to one or both of the rigid surfaces 204, so that when the base system 202 is in an open position, the tension on the straps 212 opens the poles 210 to the appropriate angles. The straps 212 may facilitate spreading a canopy 104 over the base system 202, so that the poles 210 remain stationary while the canopy 104 is attached to the interconnecting member 106. Further, in some implementations, the tension on the straps 212 may further serve to support an unsupported rigid surface 204 (e.g., if rigid surface 204*a* is mounted to a vehicle, then the straps 212 may suspend the rigid surface 204*b* which is not directly mounted to the vehicle 112).

FIG. 2B is a perspective view 250 of an example implementation of a base system 202 in a closed position. As shown in FIG. 2B, the perspective view 250 illustrates a base system 202 with the rigid surface 204*a* of a first base member 108*a* folded over the rigid surface 204*b* of a second base member 108*b* into a parallel plane when the tent system 102 is in a closed position. The base system 202 is shown pivoting about the hinges 208*a* and 208*b*. It should be noted that other components of the tent system 102, such as the poles 210, the interconnecting member 106, and the canopy 104 are not shown in the perspective view 250 of FIG. 2B.

In some implementations, as illustrated in FIG. 2B, the rigid surfaces 204*a* and 204*b* may include one or more attachment member receptacles 214*a*, 214*b*, 214*c*, 214*d* extending along the inner sides 252*a* or 252*b* of the perimeter edge 206*a* and/or 206*b*, respectively. For example, in some implementations, the rigid surface 204*b* may include two attachment member receptacles 214*b* and 214*d* around the entirety of the perimeter edge 206*b*, including the inner side 252*b* (e.g., as discussed in reference to the implementation shown in FIG. 6). In some instances, the rigid surface 204*a* may include two attachment member receptacles 214*a* and 214*c* around every side of the perimeter edge 206*a*, except for the inner side 252*a* (e.g., as discussed in reference to the implementation shown in FIG. 5).

In some implementations, the tent system 102 may include a special interconnecting member 106 with an attachment member 308 along the first longitudinal edge 408 and a second attachment member 308 along the second longitudinal edge 412. Such special interconnecting member 106 may be configured to connect the inner side 252*a* of the first base member 108*a* to the inner side 252*b* of the second base member 108*b*. In some implementations, the special interconnecting member 106 may serve as a hinge 208. In some implementations, the special interconnecting member 106 may connect the inner side 252*a* of the first base member 108*a* to the inner side 252*b* of the second base member 108*b* to provide protection for the gap between the first and second base members 108, when the tent is in an open and/or a closed position. In such implementations, the interconnecting member body 306 of the special interconnecting member 106 may be constructed of an elastic material and/or may be wide enough to bridge the gap between the first and second base members 108 (e.g., when the base system 202 is in a closed position, such as is shown in FIG. 2B).

Figure 3:
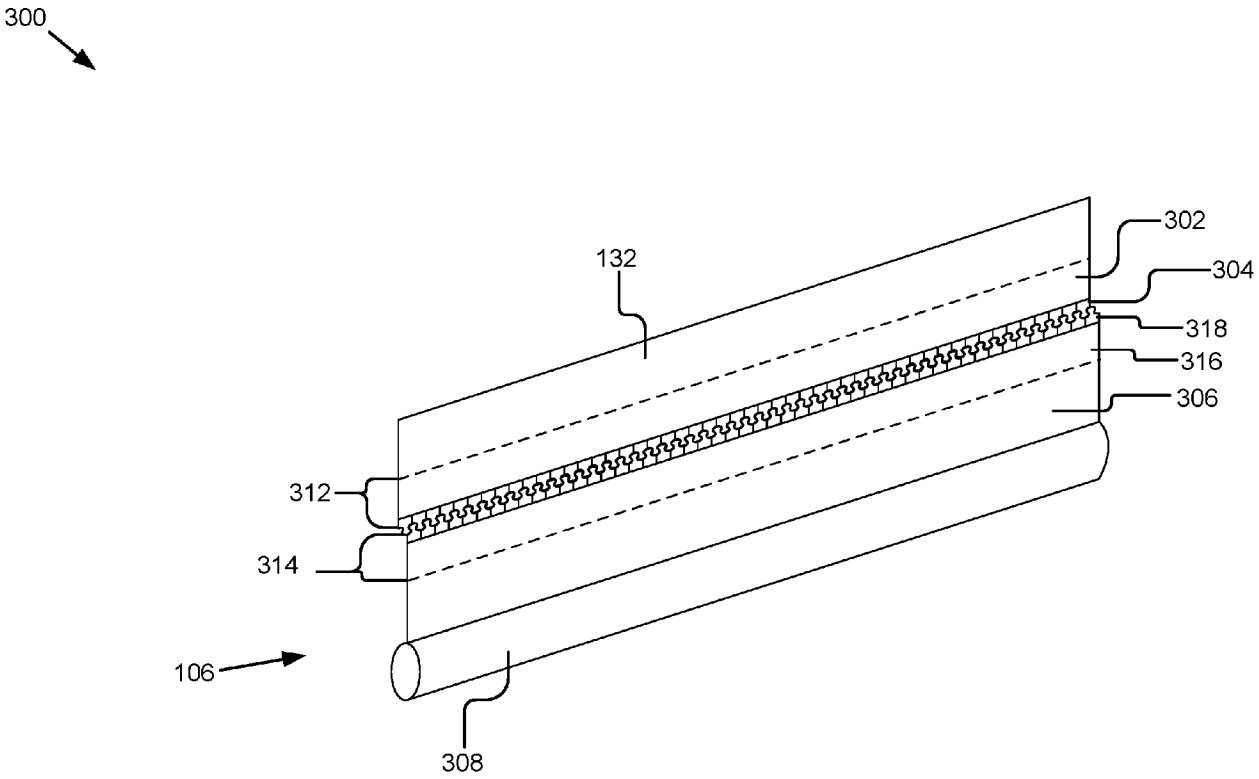
FIG. 3 is a perspective view of an example implementation of an interconnecting member mated to a canopy fastener, according to the present disclosure.

FIG. 3 is a perspective view 300 of an example implementation of an interconnecting member 106 mated to a canopy fastener 118, according to the present disclosure.

The view 300 shows a section of the membrane edge 132 of the canopy 104 attached to the canopy fastener 118. The canopy fastener 118 is a fastener that detachably affixes the canopy 104 to the interconnecting member 106. In the depicted implementation, the canopy fastener 118 includes a canopy zipper half 312 extending along and fixably attached to the membrane edge 132. A canopy zipper half 312 may include a zipper tape 302 and a series of zipper teeth 304 (also known as zipper elements) extending along and fixably attached to the zipper tape 302. The canopy fastener 118 may be adapted to mate with the interconnecting member fastener 116. For example, as depicted, the interconnecting member fastener 116 includes an interconnecting member zipper half 314, which mates with the canopy zipper half 312.

In some implementations, a special zipper may be used for the canopy zipper half 312 and/or the interconnecting member zipper half 314. Many zippers are built such that one zipper half must always mate with a unique second zipper half. In such zippers each zipper half may have a different number of zipper teeth for a given length of zipper tape, which may be true even of zipper halves that are designed to mate. For example, two zipper halves may only match up with each other, but not with other zipper halves with the same size teeth. Because each zipper half doesn't not have the same or similar number of teeth for the same or similar length of zipper tape, as unrelated zipper halves are mated, the overall length of each zipper half does not match. This problem is particularly pronounced on a long zipper, such as may be included on the interconnecting member 106. Accordingly, a special zipper may be used so that the zipper halves, as described herein, may be interchangeable. For example, each of the canopy zipper half 312 and the interconnecting member zipper half 314 may be manufactured such that they are each interchangeable with other zipper halves of similar tooth size without significantly altering the overall zipper length when the two unrelated halves are joined together. One example of zipper halves that may be used to allow interchangeability may be the Musi™ zipper made by the YKK® company, however, it should be noted that other manufacturers may also make suitable zipper halves that allow interchangeability.

It should be noted that, although the canopy fastener 118 and the interconnecting member fastener 116 are described as including a zipper/zipper halves, the fasteners may include other suitable fasteners, such as Velcro, magnets (e.g., a string of magnetic snaps, a magnetic strip, etc.), a series of snaps, a series of buttons, or any other suitable quick release mechanism.

The interconnecting member 106 illustrated in FIG. 3 may include an interconnecting member fastener 116, an interconnecting member body 306, and an attachment member 308. The interconnecting member body 306 may have a rectangular shape defining a first longitudinal edge 408 and a second longitudinal edge 412. The attachment member 308 may be attached to the interconnecting member body 306 along the first longitudinal edge 408 and the interconnecting member fastener 116 may be attached to the interconnecting member body 306 along the second longitudinal edge 412.

The interconnecting member body 306 may be constructed of the same or similar material as the flexible membrane of the canopy 104 or the interconnecting member body 306 may be constructed of a different material that is strong enough to bind the attachment member 308 to the interconnecting member fastener 116 (as well as resist any tension placed on the interconnecting member 106 from by the canopy 104 or base member 108). For example, the interconnecting member body 306 may be constructed of fabric, canvas, mesh, vinyl, nylon, polyester, etc. In some instances, the interconnecting member body 306 may be reinforced with additional layers of material and/or may be treated for weather resistance.

The interconnecting member body 306 may have various sizes depending on the implementation. For example, the width of the interconnecting member body 306 (e.g., the distance between the first longitudinal edge 408 and the second longitudinal edge 412) may be 1-4 inches, although other implementations are possible.

In some implementations, the length of the interconnecting member body 306 may correspond to the distance along three or four sides of the perimeter edge 206 of one or more of the rigid surfaces 204, depending on the implementation. For example, in some implementations, as described in reference to FIG. 5, the length of an interconnecting member body 306 may correspond to the distance along three sides of the perimeter edge 206 of a single rigid surface 204. In some implementations, the length of the interconnecting member body 306 may correspond to the distance around 4 sides of the base system 202, for example, the interconnecting member body 306 may be configured to extend around 6 sides of the perimeter edges 206*a* and 206*b* of base members 108*a* and 108*b*. Further, in some instances, the interconnecting member body 306 may include additional length or an elastic section to enable the interconnecting member 106 to remain attached to the attachment member receptacles 214 of the base system 202 when the base system 202 is in a closed position (e.g., as depicted in FIG. 2B).

Figure 5:
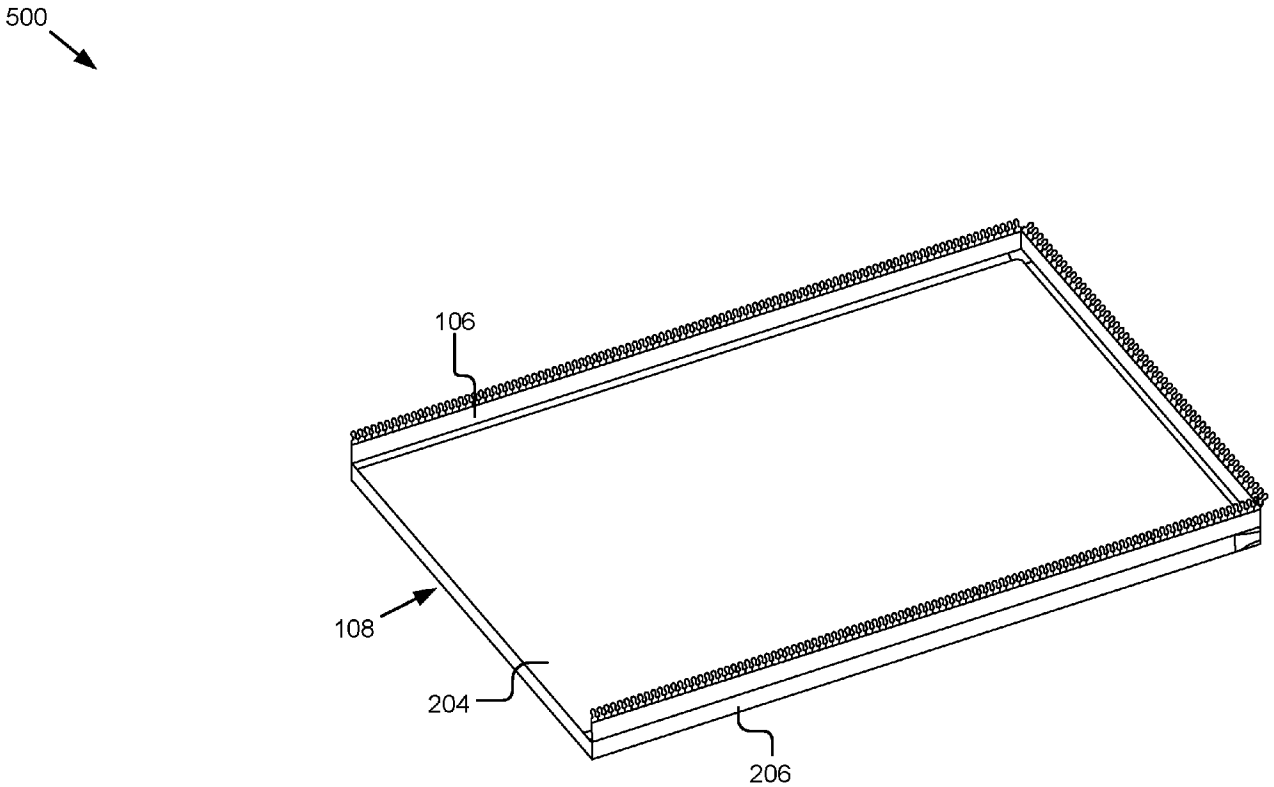
FIG. 5 is a perspective view of an example implementation of an interconnecting member attached to an example implementation of a base member, according to the present disclosure.
Figure 7:
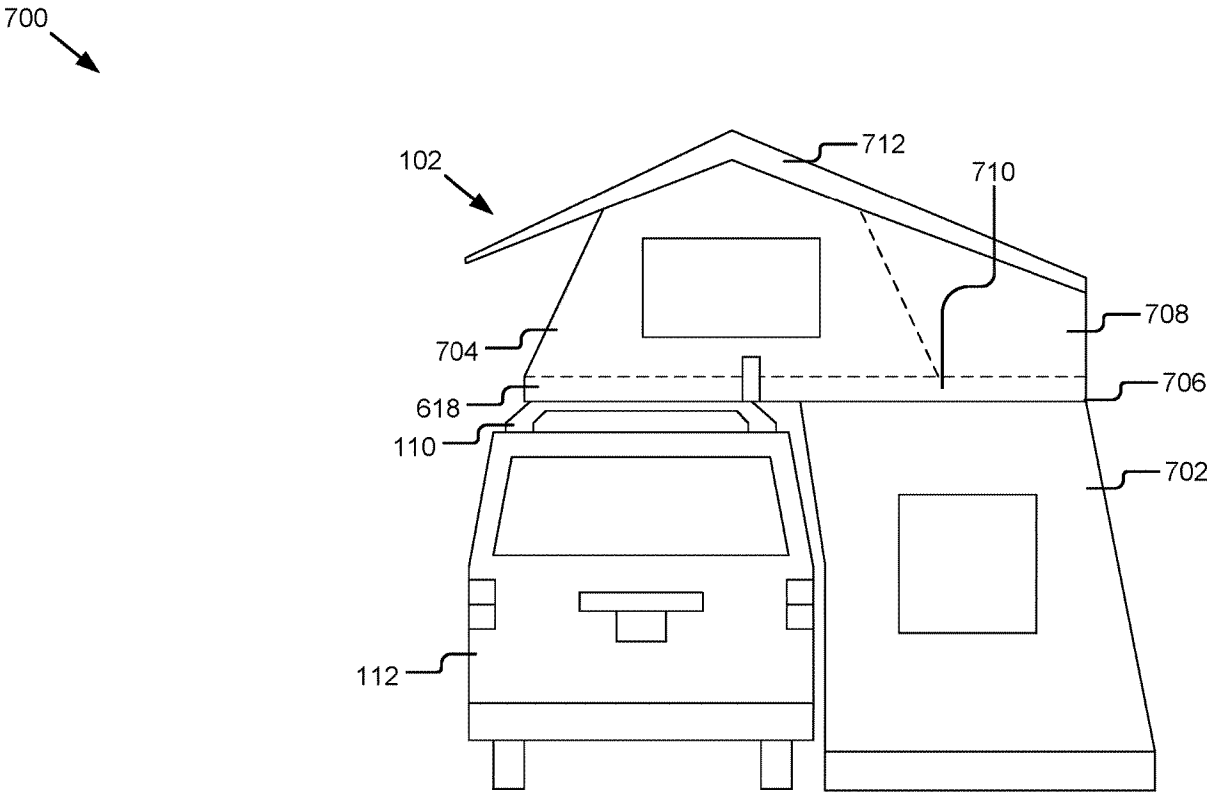
FIG. 7 is a side view of an example implementation of a tent system with annex mounted to a vehicle, according to the present disclosure.

In some implementations, the tent system 102 may include multiple interconnecting members 106 each having a different length. For example, the tent system 102 may include two interconnecting members 106, each of which is configured as shown in the example of FIG. 5. In some instances, the tent system 102 may also include two or more additional interconnecting members 106 for attaching an additional canopy 104, portion of a canopy 104, cover, or annex 702 (e.g., as shown in FIG. 7). It should be noted that other lengths and widths are possible without departing from the scope of the techniques described herein.

The attachment member 308 is configured to attach or otherwise connect with the base system 202, for example, the attachment member 308 may be attached to the interconnecting member body 306 along a first longitudinal edge 408. In some implementations, the attachment member 308 may be configured for insertion or other interaction with the attachment member receptacle 214. For example, the attachment member 308 may be sized for insertion into an attachment member receptacle (e.g., a channel defined by the base member 108), so that when the attachment member 308 is inserted into the attachment member receptacle 214, the attachment member 106 and the base member 108 are fixably attached to each other. In some instances, the fit of the attachment member 308 and the attachment member receptacle 214 may be tight enough to form a watertight seal.

In some implementations, the attachment member 308 may include adhesive, screws, clamped fabric, a bolt cord 404, or other means of attaching the interconnecting member body 306 to the base member 108. In some implementations, the attachment member 308 may include a bolt cord 404 or welt cord. For example, the attachment member 308 may include a cord sewn into or otherwise connected to a longitudinal edge 408 of the interconnecting member body 306. Suitable materials for the cord may include a rope, a plastic or rubberized strand, cloth piping, roll of fabric, etc.

The interconnecting member fastener 116 may be any fastener configured to attach the interconnecting member body 306 to the canopy 104 (e.g., to the canopy fastener 118). The interconnecting member fastener 116 may be configured to mate with any one of a plurality of different canopy fasteners 118, so that when the interconnecting member fastener 116 and canopy fastener 118 are mated, the interconnecting member 106 and canopy 104 are detachably, but securely, connected. The interconnecting member fastener 116 may be attached to the interconnecting member body 306 along the second longitudinal edge 412 of the interconnecting member body 306.

In the implementation depicted in FIG. 3, the interconnecting member fastener 116 may include an interconnecting member zipper half 314. The interconnecting member zipper half 314 may have a zipper tape 316 and a series of zipper teeth 318 extending along and fixably attached to the zipper tape 316. The interconnecting member zipper half 314 may be configured to attach to any one of a plurality of different canopy zipper halves 312. Accordingly, one or more different canopies 104 may interchangeably connect to the interconnecting member 106. For example, the interconnecting member zipper half 314 may be of the special zipper types described above in reference to the canopy zipper half 312.

Figures 4A, 4B:
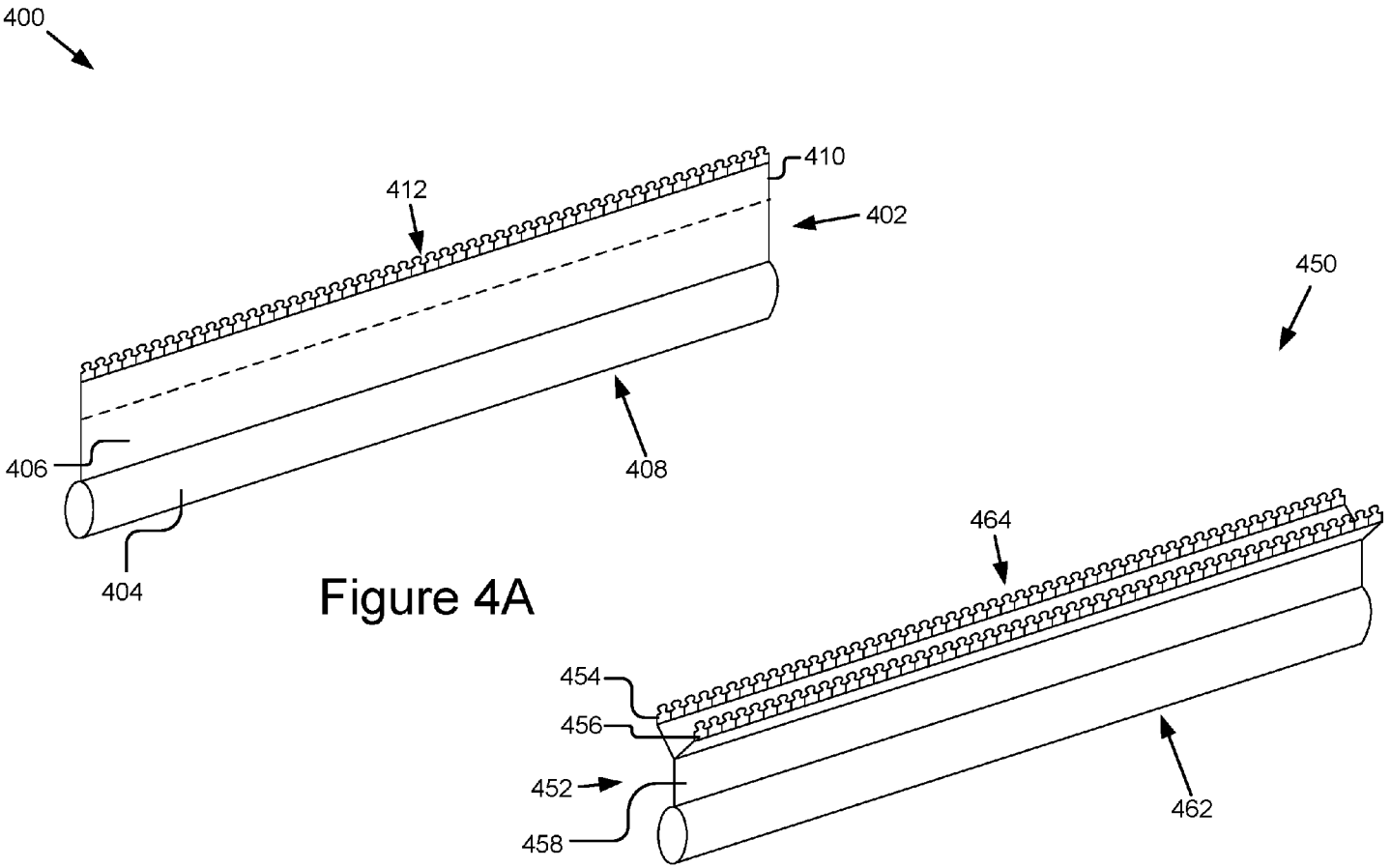
FIGS. 4A and 4B are perspective views of example implementations of interconnecting members, according to the present disclosure.

FIG. 4A is a perspective view 400 of an example implementation of an interconnecting member 106, according to the present disclosure. As described above, the interconnecting member 106 may be a gimp 402, which includes a bolt cord 404. The bolt cord 404 may include a cord longitudinally attached to the gimp body 406 along a first longitudinal edge 408. The bolt cord 404 may be adapted for insertion into an attachment member receptacle 214 of the base system 202. For example, the bolt cord 404 may interact with a base member 108 by sliding into the attachment member receptacle 214. In some implementations, because the bolt cord 404 may be difficult to slide into and/or out of the attachment member receptacle 214 on a base member 108, the bolt cord 404 may be attached to the base member 108 at the factory and may not be removable by a user. Moreover, although the attachment member 308 may be another mechanism than a bolt cord 404, as described above, the attachment member 308 may generally be a permanent or semi-permanent installation, so that it is difficult to easily or quickly remove from a base member 108, or install and align on the base member 108.

Further, as described above, the gimp 402 may include an interconnecting member fastener 116, such as a gimp zipper half 410 longitudinally attached to the gimp body 406 along the second longitudinal edge 412. An interconnecting member zipper half 314, such as the gimp zipper half 410 allows the canopy 104 to be quickly attached or removed from the base member 108. Further the gimp zipper half 410 automatically aligns and securely attaches the canopy 104 to the base member 108.

FIG. 4B is a perspective view 450 of an example implementation of an interconnecting member 452 (which is an implementation of the interconnecting member 106), according to the present disclosure. The interconnecting member 452 may include an attachment member 460 along a first longitudinal edge 462 of an interconnecting member body 458. The interconnecting member 452 may include a first interconnecting member fastener 454 and a second interconnecting member fastener 456 each attached to the interconnecting member body 458 along a second longitudinal edge 464. Similar to the interconnecting member fastener described elsewhere herein, the second interconnecting member fastener 456 may include an interconnecting member zipper half 314 with zipper tape 316 and series of zipper teeth 318 fixably attached to the zipper tape 316.

The second interconnecting member fastener 456 may be configured to mate with any one of a plurality of different canopy fasteners 118. For example, the second interconnecting member fastener 456 may mate with a second canopy 104 (e.g., with a second canopy fastener 118, which may include a second flexible membrane defining a second membrane edge 132 and a second canopy fastener 118, as described above). For example, the first interconnecting member fastener 454 may connect a first canopy 104 (e.g., a mesh or lightweight canopy 104) and the second interconnecting member fastener 456 may connect a second canopy 104 (e.g., a rainfly, weather resistant, insulating, or other canopy 104).

In some implementations, the second interconnecting member fastener 456 may connect a cover (not shown) when the tent system 102 is in a closed position. For example, the tent system 102 (e.g., a base system 202, tent poles 210, canopy(ies) 104) may fold or compress when the tent system 102 is a closed position and a cover (e.g., made of canvas, tent material, vinyl, etc.) may cover the closed tent system 102. For example, a cover may attach to an interconnecting member 106, in a similar way as is described in reference to the canopy 104. For example, in some implementations, a canopy 104 may attach to the first interconnecting member fastener 454 and a cover may connect to the second interconnecting member fastener 456.

In some implementations, the second interconnecting member fastener 456 may connect an annex 702, as shown and described in reference to FIG. 7.

In some implementations, the first interconnecting member fastener 454 and the second interconnecting member fastener 456 may be different lengths, so that the first interconnecting fastener 454 may mate with a first configuration of a canopy 104 and the second interconnecting member 456 may mate with a cover or a second configuration of a canopy 104 (e.g., a water-resistant or solid canopy 104, etc.). For example, in some implementations, the first interconnecting fastener 454 may be configured to extend along three sides of a perimeter edge 206 of the rigid surface 204 (e.g., as illustrated in FIG. 5), but the second interconnecting fastener 456 may be configured to extend along four sides of a perimeter edge 206 the rigid surface 204.

Although FIG. 4B illustrates an interconnecting member 452 with two interconnecting member fasteners 454 and 456, it should be understood that other configurations are possible, for example, an interconnecting member 452 may include three interconnecting member fasteners 116 (e.g., one interconnecting member fastener 116 for a mesh canopy 104, one interconnecting member fastener 116 for a rain fly, and one interconnecting member fastener 116 for a cover or annex 702). The use of an interconnecting member 542 with multiple interconnecting member fasteners 116 may allow the base member 108 to include a single attachment member receptacle 214, while accommodating multiple canopies 104 and/or a cover.

FIG. 5 is a perspective view 500 of an example implementation of an interconnecting member 106 attached to a base member 108. In the depicted implementation, the interconnecting member 106 is connected along three sides of the perimeter edge 206 of the rigid surface 204. For example, the rigid surface 204 may correspond to one rigid surface 204*a* or 204*b*, as illustrated in FIG. 2A.

In some implementations, the tent system 102 may include a second base member 108 (e.g., as in the base system 202 illustrated in FIG. 2A) with a second interconnecting member 106. For example, a first interconnecting member 106 may be attached to a first rigid surface 204*a* and a second interconnecting member 106 may attach a second rigid surface 204*b*. In some implementations, one or both of the rigid surfaces 204*a* and 204*b* include one or more different implementations of interconnecting members 106, as described herein. For example, the first interconnecting member 106 may have a different length (e.g., along four edges of the rigid surface 204*a*) than the second interconnecting member 106 (e.g., along three edges of the rigid surface 204*b*). Similarly, each of the first and second interconnecting members 106 may have different configurations of the number of interconnecting member fasteners 116 (e.g., 454 and 456) used. Such different configurations of interconnecting members 106 or 452 (e.g., as shown in FIG. 6) may allow a canopy 104 to be connected along the perimeter edge formed when two rigid surfaces 204*a* and 204*b* are combined, while also allowing a cover to be attached to one rigid surface 204*a* when the tent system 102 is in a closed position.

Further, it should be noted that although the example of the interconnecting member 106 shown in FIG. 5 is continuous around three edges of the rigid surface 204, in some implementations, multiple interconnecting members 106 may be used, for example, three shorter interconnecting members 106 may replace a U shaped interconnecting member 106 shown in FIG. 5.

Figure 6:
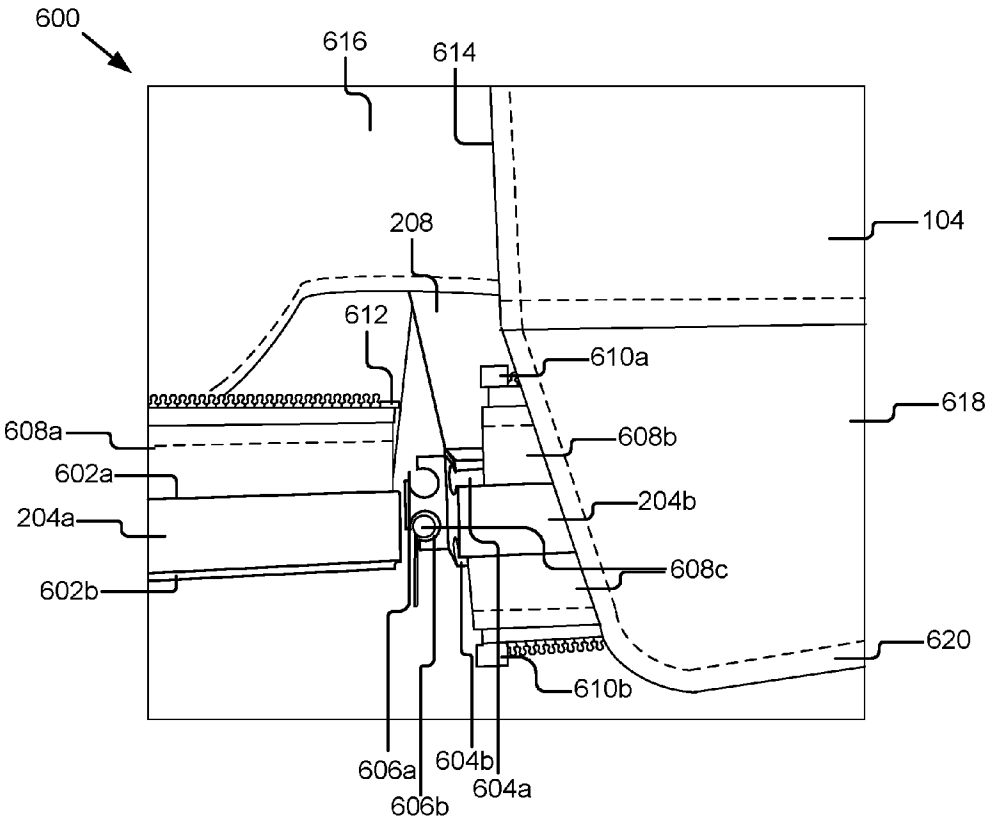
FIG. 6 is a side view of a partial section of an example implementation of a tent system, according to the present disclosure.

FIG. 6 is a side view 600 of a partial section of an example implementation of a tent system 102, according to the present disclosure. Some components of the tent system 102 are not shown in the side view 600 in order to expose other components, for clarity and explanation herein. For example, portions of a canopy 104, canopy fasteners 118, zipper sliders, etc., are omitted from the side view 600 depicted in FIG. 6.

The side view 600 shows a hinge 208 attached to a first rigid surface 204*a* and a second rigid surface 204*b*. As illustrated, the first rigid surface 204*a* may include two attachment member receptacles 602*a* and 602*b* and the second rigid surface 204*b* may include two attachment member receptacles 604*a* and 604*b*. The rigid surface 204*b* may also include a third and fourth attachment member receptacle 606*a* and 606*b* running along a perimeter edge of the second rigid surface 204*b* between the first and second rigid surfaces 204*a* and 204*b*, as shown in the side view 600.

As illustrated in FIG. 6, the attachment member receptacles 602*a* and 604*a* each have attached thereto interconnecting members 608*a* and 608*b*, respectively. In the depicted implementation, the interconnecting members 608*a* and 608*b* may be used to connect a single canopy 104. For example, a canopy 104 may include two canopy fasteners 118 (not shown in FIG. 6), which are connected along a membrane edge 132 of the canopy 104 and each correspond to an interconnecting member 106, such as is illustrated in FIG. 5. The break between the interconnecting member 608*a* and the interconnecting member 608*b* (as well as the corresponding canopy fasteners) may allow the tent system 102 to be folded at the hinge 208 to a closed position when not in use, as described elsewhere herein. Accordingly, the canopy fastener 118 and interconnecting member 106 may not extend up the slit 610 in the side of the canopy 104, according to some implementations of the techniques described herein.

The attachment member receptacles 604*b* and 606*b* may have attached thereto a single interconnecting member 608*c*. For example, the interconnecting member 608*c* may extend around all four edges of a rigid surface 204 and be used to attach a cover to the tent system 102 when the tent system 102 is in a closed position.

In the implementation shown in FIG. 6, zipper retainer boxes 610*a* and 610*b* may be seen attached to the interconnecting members 608*b* and 608*c*. Similarly, a zipper pin box 612 may be seen attached to the interconnecting member 608*a*.

In some implementations, the canopy 104 may include a slit 614 (only one side of the slit 614 is shown in the side view 600) in the flexible membrane of the canopy 104 where the canopy 104 crosses the hinge 208. The slit 614 is configured to allow the canopy 104 to fold without being detached from the rigid surfaces 204. It should be noted that, in some implementations, the slit 614 may alternatively be replaced with an elastic portion of the flexible membrane of canopy 104 to allow the canopy 104 to fold with the base system 202 while attached to the rigid surfaces 204. Additionally, the canopy 104 may include a slit cover 130 (e.g., constructed of the same or similar material as the flexible membrane), as shown in FIG. 1. The slit cover 130 may be configured to protect the slit 614 from insects, rain, wind, etc., and may be secured to the canopy 104 using Velcro, or a similar attachment mechanism.

In some implementations, the canopy 104 may include an inner membrane 616 attached to the flexible membrane and configured to provide additional protection for the hinge 208.

In some implementations, the canopy 104 may include a flap 618 attached to the flexible membrane along the membrane edge 132. The flap may include a substantially rectangular strip of flexible material (e.g., the flap 618 may constructed of the same or similar material as the flexible membrane). A longitudinal edge of the flap 618 may be welded, sewn, or otherwise attached to the flexible membrane, for example, along or near (e.g., within five to ten inches of) the membrane edge 132. The flap 618 may be configured to provide additional protection to the canopy fastener 118, the interconnecting member 106 (or 608), and the base member 108. For example, the flap 618 may be adapted to extend from the membrane edge 132 of the flexible membrane of the canopy 104 and overlap the canopy fastener 118, the interconnecting member fastener 116, the interconnecting member body 306, and the perimeter edge 214 of the base member 108 to provide weather (e.g., rain) protection for each of these components. In some implementations, to provide additional protection for the interconnecting member 106, the flap 618 may include a draw string or elastic (not shown) along its edge 620, which may enable the flap 618 to provide additional weather protection to the interconnecting member 106 by securing the flap 618 under the rigid surface 204.

FIG. 7 is a side view 700 of an example implementation of a tent system 102 with annex 702 mounted to a vehicle 112, according to the present disclosure. In the depicted implementation, the tent system 102 includes an expanded canopy 704 with a suspended fly 712 on a base member 108 (the base member is not visible in the side view 700, because it is covered by a flap 618). The base member 108 may be mounted to a roof rack 110 of a vehicle 112, as described in reference to FIG. 1.

In some implementations, the base member 108 is smaller than the expanded canopy 704, so the expanded canopy 704 interacts with, or includes, a frame (not shown) that supports the additional canopy portion 708 and the interconnecting member 106 connects to an inner door portion of the expanded canopy 704 (e.g., an inner door portion may connect at an edge 710 of the base member 108 such that the expanded canopy 704 includes an inner door portion and an expanded portion covering the annex 702). In some implementations, the base member 108 may include an attachable or telescoping bar (not shown) on one side for extending an edge 706 (e.g., a perimeter edge) of the base member 108 to accommodate for an expanded canopy 704 and/or annex 702. Accordingly, an interconnecting member 106 (also not visible in the side view 700) may be attached to the attachable or telescoping bar.

In some implementations, the tent system 102 may include a second interconnecting member 106, or an interconnecting member 452 with multiple interconnecting member fasteners, which allows the base member 108 to connect to an annex 702. The annex 702 may include a flexible annex membrane which defines an annex edge (the annex edge is not shown because in the depicted limitation it is covered by the flap 618). In some implementations, the annex 702 may be constructed of the same or similar material as the canopy 104. The annex edge may include an annex fastener, whose construction and functionality may correspond to the construction and functionality of the canopy fastener 118 described above. The annex fastener may connect to the interconnecting member fastener 116 in the same or similar way as the canopy fastener 118.

The annex 702 may be positioned below a base member 108. In some implementations, the annex 702 may be positioned both below the base member 108 and extending out to the side of the base member 108 and may conceal the support 114. Further, in some implementations, the height of the annex 702 may be expandable (e.g., a floor of the annex 702 may be adjustable) to accommodate different heights of vehicles 112.

In the foregoing description, for purposes of explanation, numerous specific details are set forth in order to provide a thorough understanding of the technology. It will be apparent, however, that the technology described herein can be practiced without these specific details.

Reference in the specification to one implementation", an implementation", "some implementations", or "other implementations" means that a particular feature, structure, or characteristic described in connection with the implementation is included in at least one implementation of the disclosure. The appearances of the term "implementation" or "implementations" in various places in the specification are not necessarily all referring to the same implementation.

In addition, it should be understood and appreciated that variations, combinations, and equivalents of the specific implementations, implementations, and examples may exist, are contemplated, and are encompassed hereby. The invention should therefore not be limited by the above described implementations, implementations, and examples, but by all implementations, implementations, and examples, and other equivalents within the scope and spirit of the invention as claimed.

What is claimed is:

1. A tent system comprising:

a base system including a first base member and a second base member, the first base member having a first rigid surface with a first perimeter edge, the first base member configured to mount to a vehicle, the first base member defining a first channel along at least a portion of the first perimeter edge, the first channel adapted to receive and retain a first attachment member, the second base member having a hinge and a second rigid surface defining a second perimeter edge, the hinge pivotally attaching the first base member to the second base member, the second base member defining a second channel along the second perimeter edge, the second channel adapted to receive and retain a second attachment member, the second rigid surface positioned substantially planar with the first rigid surface when the first base member is mounted to the vehicle and the second base member is in an open position, the second base member adapted to fold into a parallel plane over the first base member when the tent system is in a closed position;

a first canopy including a flexible membrane having a membrane edge and a first canopy zipper half, the first canopy zipper half extending along and fixably attached to the membrane edge, the first canopy zipper half having a first zipper tape and a first series of zipper teeth extending along and fixably attached to the first zipper tape, the first canopy zipper half adapted to mate with a first gimp zipper half; and a first gimp including a first gimp body, the first attachment member, and the first gimp zipper half, the first gimp body having a rectangular shape defining a first longitudinal edge and a second longitudinal edge, the first attachment member attached to the first gimp body along the first longitudinal edge, the first attachment member sized for insertion into the first channel defined by the first base member so that when the first attachment member is inserted into the first channel, the first gimp and the first base member are fixably attached together, the first gimp zipper half having a second zipper tape and a second series of zipper teeth extending along and fixably attached to the second zipper tape; the first gimp zipper half attached to the first gimp body along the second longitudinal edge, the first gimp zipper half configured to mate with a plurality of different canopy zipper halves so that when the first canopy zipper half and the first gimp zipper half are mated, the first gimp and the first canopy are connected.

2. The tent system of claim 1, wherein the first gimp zipper half and the first canopy zipper half form a quick release system, the quick release system allowing the first canopy to be quickly disconnected from the base system, the quick release system further allowing the first canopy to be quickly aligned and connected to the base system.

3. The tent system of claim 1, wherein the first attachment member includes a bolt cord, the bolt cord including a cord longitudinally attached to the first gimp body along the first longitudinal edge, the bolt cord adapted for insertion into the first channel of the first base member.

4. The tent system of claim 1, wherein the first canopy further includes a flap attached to the flexible membrane along the membrane edge, the flap adapted to overlap the first zipper half, the second zipper half, the first gimp body, and the first perimeter edge of the first base member when the first canopy is attached to the first base member via the first gimp, the flap providing weather protection for the first canopy zipper half, the first gimp zipper half, the first gimp body, and the first perimeter edge of the first base member.

5. The tent system of claim 1, further comprising a second gimp including a second gimp body, the second attachment member, and a second gimp zipper half, the second gimp body having a rectangular shape defining a third longitudinal edge and a fourth longitudinal edge, the second attachment member attached to the second gimp body along the third longitudinal edge, the second attachment member sized for insertion into the second channel defined by the second base member so that when the second attachment member is inserted into the second channel the second gimp and the second base member are fixably attached to each other, the second gimp zipper half having a third zipper tape and a third series of zipper teeth extending along and fixably attached to the third zipper tape; the second gimp zipper half attached to the second gimp body along the fourth longitudinal edge, the second gimp zipper half configured to mate with any one of a plurality of different canopy zipper halves so that when the first canopy zipper half and the second gimp zipper half are mated, the second gimp and the first canopy are connected.

6. The tent system of claim 1, wherein the first gimp includes a second gimp zipper half attached to the first gimp body along the second longitudinal edge, the second gimp zipper half having a third zipper tape and a third series of zipper teeth extending along and fixably attached to the third zipper tape, the second gimp zipper half configured to mate with a plurality of different canopy zipper halves.

7. The tent system of claim 6, further comprising a second canopy, the second canopy including a second flexible membrane defining a second membrane edge and a second canopy zipper half, the second canopy zipper half extending along and fixably attached to the second membrane edge, the second canopy zipper half having a third zipper tape and a third series of zipper teeth extending along and fixably attached to the third zipper tape, the second canopy zipper half adapted to mate with a second gimp zipper half.

* * * * *